United States Patent [19]

Blodgett

[11] 4,248,278

[45] Feb. 3, 1981

[54] FILLING DEVICE FOR FREEZER BAGS

[76] Inventor: Carl N. Blodgett, 217 Pineridge Ct., Wake Forest, N.C. 27587

[21] Appl. No.: 56,604

[22] Filed: Jul. 11, 1979

[51] Int. Cl.[3] ..... B65B 39/06

[52] U.S. Cl. ..... 141/316; 141/390; 248/99

[58] Field of Search ..... 141/1, 114, 313–317, 141/331–345, 390, 391; 248/99

[56] References Cited

U.S. PATENT DOCUMENTS

| | | | |
|---|---|---|---|
| 2,827,931 | 3/1958 | Melvin | 141/331 |
| 3,818,956 | 6/1974 | Chamberlain | 141/316 |

*Primary Examiner*—Frederick R. Schmidt

[57] ABSTRACT

A device for holding and supporting a bag, such as plastic freezing bags, in an open position for convenient filling. The bag supporting and holding device includes upstanding sides that allows an open top portion of the bag to be cuffed back thereover so as to define an interior open top portion of the bag about the sides engaging the cuff of the bag. An insert is provided that is adapted to be placed between the sides of the bag support and holding device and directly adjacent the interior of the supported open top bag. Projecting outwardly from the insert is a shield that projects the portion of the bag cuffed back over the sides and the insert itself further protects the interior of the bag about the top thereof from being exposed to the material being filled within the bags. Further the insert is provided with a funnel that projects upwardly to facilitate filling.

8 Claims, 3 Drawing Figures

FILLING DEVICE FOR FREEZER BAGS

The present invention relates to support and filling devices for bags and more particularly to a bag support and filling device for plastic freezing bags such as used to contain fruits and vegetables.

BACKGROUND OF INVENTION

In recent years, home canning and freezing has been becoming increasingly popular. For one reason, such is a very practical and economical means for providing food for one or one's family. In addition, the quality, especially taste, is often much better with fruits and vegetables that have been home canned or frozen than those that may be purchased in the supermarket. This is true for various reasons, but one of the most significant is the fact that the individual can choose and select the quality and maturity of the fruits and vegetables that are going to be canned or frozen.

Probably home freezing is generally preferred over canning because it is generally less trouble and because the true taste of the product being frozen can be maintained quite well in a frozen environment. But even still, home freezing requires time and effort and there are certain problems and inconveniences involved.

One area that is of concern is in the area of filling and sealing the plastic freezer bags. Here it is desirable to have a bag holding device that will hold and support the freezer bag in an open position such that fruits, vegetables or whatever products are being frozen can easily be poured into the bag. In the past, there have been bag holders for holding plastic bags in an open position for easy filling. For example, one can see these in the disclosures of U.S. Pat. Nos. 3,818,956 and 4,133,356.

But one particular problem that has continually been present in the area of sealing is that of achieving a good seal. In this regard, it is important in order to gain a strong and air tight seal that no material from the product being frozen be exposed or come in contact with the inside of the bag at the top portion thereof where the heat seal is applied. If such does occur, this will severely hamper the sealing process and will often result in less than a secure and air tight seal.

SUMMARY OF THE INVENTION

The present invention presents a freezer bag holding and supporting device that is adapted to hold and retain a freezer bag in an upright open position for convenient and easy filling. More particularly, the freezer bag support and holding device is provided with means for protecting the inside top portion of the bag such that during the filling process the product material being filled will not come into contact with the top inside portion of the bag, and consequently this means that the same freezer bag can be securely sealed without any chance of problems occurring because of the product material coming into contact with the bag about the inside area where the seal is formed.

In particular, in a preferred embodiment of the present invention, the bag support and holding device comprises an upright support stand having side means that project upwardly in lateral spaced apart relationship and includes an upper terminal end for allowing a freezer bag to be cuffed back thereover, so as to define an open top within the bag. Further, forming a part of the present invention is an insert that is inserted within the defined open top and between the support means extending within the defined cuff. The insert includes an upwardly projecting funnel which enables the bag to be filled easily and further includes a downwardly projecting side shield structure that shields the exteriorly exposed cuff portion of the bag, which is in fact the top interior portion of the bag. The presence of the shield assures that product material being filled is not spilled or splashed onto the exterior of the cuff portion of the bag which eventually becomes the interior of the bag and which is subjected to the heat sealing process.

It is, therefore, a primary object of the present invention to provide a new, unique and improved freezer bag holding device that will support a freezer bag in an upright open position for convenient and easy filling.

Still a further object of the present invention is to provide a freezer bag holding device of the character described above which in addition is provided with means to assure that the interior portion of the bag adjacent the top opening is maintained in a clean state and is not exposed in any way to the product material being filled so as to assure a strong and air tight heat seal.

Another object of the present invention is to provide a freezer bag holding device of the character described above which is relatively simple in design, easy to manufacture, sturdy and strong, and which is easy for the housewife or other individual to use.

It is also an object of the present invention to provide a freezer bag holding device of the character described above that is particularly suited for various size and shape freezer bags.

Another object of the present invention resides in the provision of a freezer bag holder which is easy to use and which is designed to increase the efficiency of the home freezing process.

Still a further object of the present invention resides in the provision of a freezer bag holder of the character described above which is particularly suited to be constructed of a plastic like material.

Finally another object of the present invention resides in the provision of a freezer bag holder of the character described above which is particularly designed to hold and support the freezer bag in an open position in a sturdy manner thereby assuring that the freezer bag is supported in such a way that it will not inadvertently slip from the support stand and result in the product being spilled.

Other objects and advantages of the present invention will become apparent from a study of the following description and the accompanying drawings which are merely illustrative of the present invention.

DESCRIPTION OF PREFERRED EMBODIMENT

Figure 3:
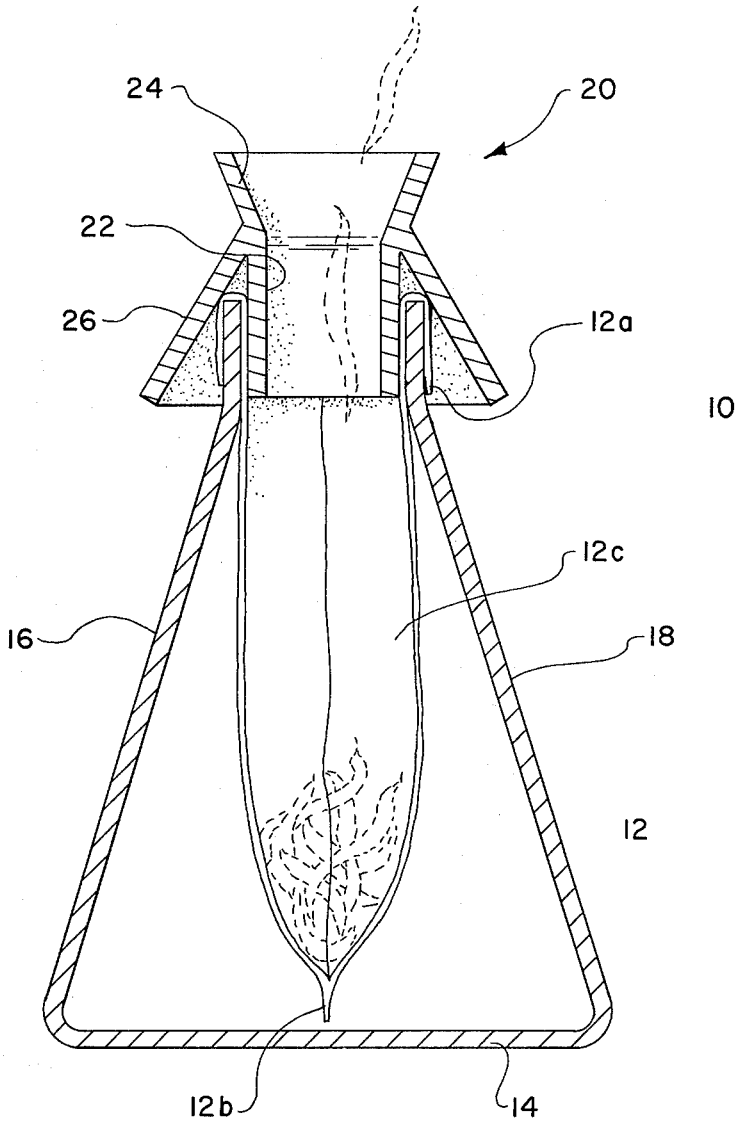
FIG. 3 is a sectional view taken along the lines 3—3 in FIG. 1.

With further reference to the drawings, the plastic bag holding and supporting device of the present invention is shown therein and indicated generally by the numeral 10. As seen in FIG. 3, the bag holding device 10 is adapted to support a freezer type plastic bag 12 of the general type having an open top 12*a*, a bottom 12*b*, and a side wall structure 12*c*.

Figure 1:
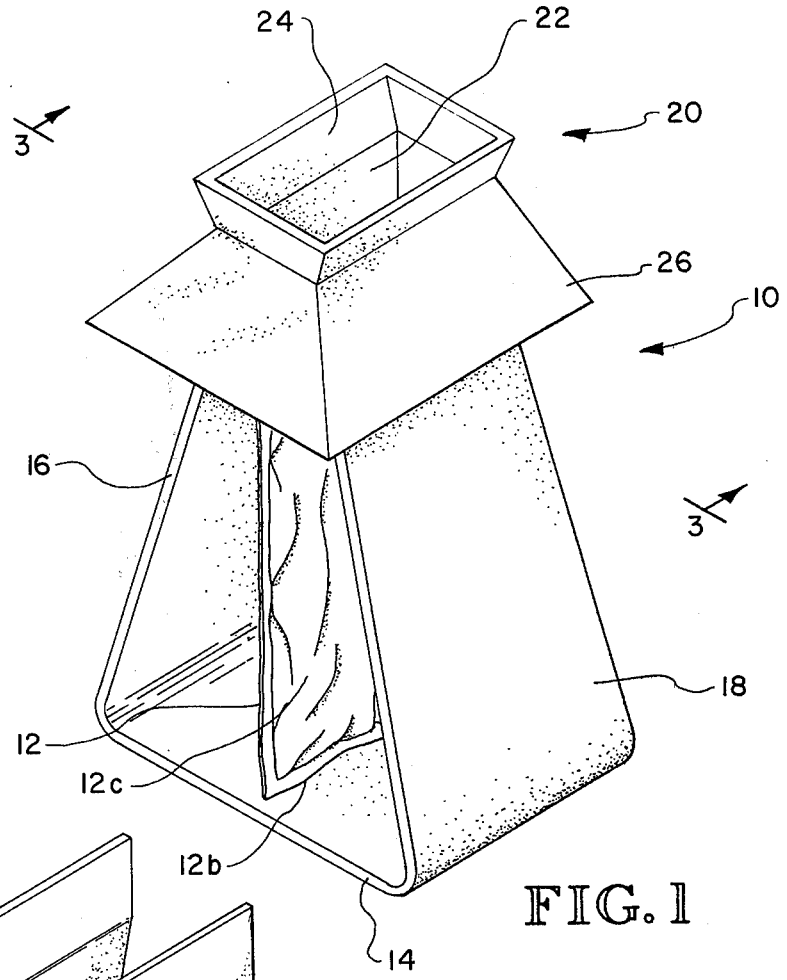
FIG. 1 is a perspective view of the freezer bag holding and supporting device of the present invention.
Figure 2:
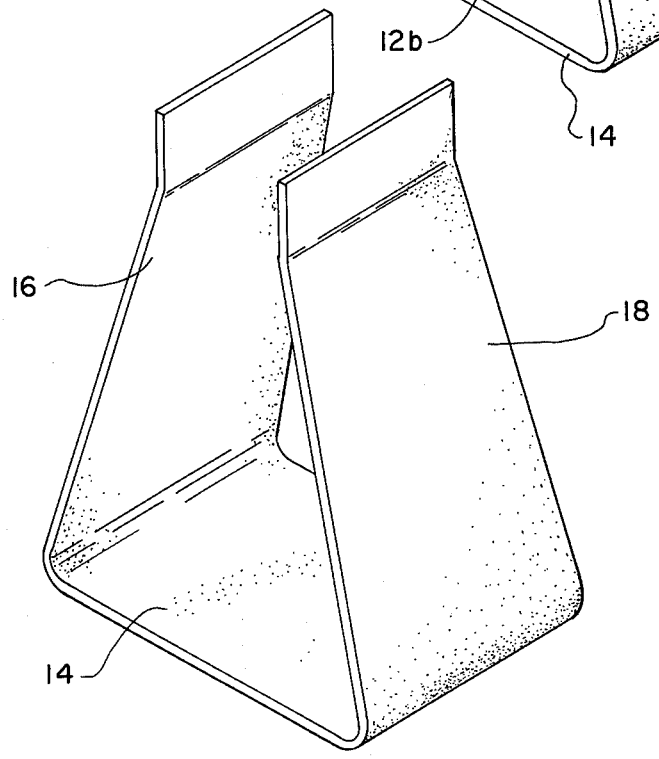
FIG. 2 is a perspective view of the base portion of the freezer bag holding device of the present invention.

With reference to FIGS. 1 and 2, bag holding device 10 includes a base unit that includes an integrally constructed bottom 14 and two upstanding side means 16 and 18. As seen in FIG. 2, the base unit generally forms a U-shape and it is seen that the sides 16 and 18 generally extend inwardly from the opposite sides of the bottom 14 for a predetermined distance, at which point they extend generally upwardly in parallel relationship.

The upper terminal edge of sides 16 and 18 is adapted to receive and support plastic bag 12 by simply cuffing the open top portion of the bag back over the exterior sides of the upper terminal portions of sides 16 and 18, as best seen in FIG. 3. This defines a cuff about the top portion of the bag and it is the cooperation of the upper portions of sides 16 and 18 with the formed cuff that enables the bag to be supported vertically between sides 16 and 18.

Once bag 12 is properly supported about the base unit, the bag holding device includes insert means indicated generally by the numeral 20 that is inserted into the defined open top of the bag, again as best illustrated in FIG. 3. Viewing insert 20 in detail, it is seen that the same includes an insert portion 22 that fits interiorly of sides 16 and 18 and in fact directly engages the inside of bag 12 about the open top portion defined by the supported bag 12. Extending upwardly from the insert portion is a funnel portion 24 that converges upwardly so as to facilitate the filling of the bag. Extending outwardly from the insert 20 around the entire insert is a shield portion 26 that extends over the upper portions of sides 16 and 18 so as to shield the exposed top interior of the bag 12 which forms a part of the cuff.

It is thusly seen that the interior portion of the bag about the top portion thereof is completely protected against the possibility of the product material being spilled or exposed thereto during the filling process. This will assure that once the bag is filled and the insert 20 removed, that the top of the bag 12 can be heat sealed without any chance that the seal will be affected by the presence of material from the product being filled being exposed to the inside of the bag in the area where the heat seal is conventionally applied.

It should be pointed out that one particular feature of the present invention that is significant is the fact that the sides 16 and 18 would preferably be slightly yieldable outwardly such that the insert 20 could be easily inserted between the sides 16 and 18 and once this is done that the sides 16 and 18 would tend to exert a biasing or compressing action against the insert. This would assure that the bag would be securely supported in an upright open position and that the top interior portions of the bag would be protected.

In the preferred embodiment disclosed herein, it is seen that insert 20 comprises a generally rectangular cross sectional area inasmuch as the insert portion includes four sides and the funnel portion 24 likewise including four sides. Similarly the shield portion 26 includes four downwardly extending sides. It is appreciated that in certain cases the shape of the insert 20 may be varied to accommodate certain desired features or conveniences.

It is thusly appreciated that in filling each freezer bag 12 that the bag is first inserted and cuffed over the base support unit as suggested in FIG. 3, after which the insert is inserted downwardly therein between sides 16 and 18. After this the product material being frozen is conveyed or poured downwardly into the funnel portion 24 and into the bag 12. It is seen that the particular shape of the base support unit and the sides 16 and 18 allows the bag 12 to expand as it is filled. After filling, insert 20 is removed and bag 12 is removed from the base support unit and the top portion thereof is then in conventional fashion exposed to a heat sealing device that seals the bag in a strong and air tight sealed relationship. This process is continued from one bag to another until the freezing process is completed.

From the foregoing specification, it is clear that the freezer bag filling device of the present invention presents a new and improved device for filling freezer bags, especially in home freezing use. It is particularly useful inasmuch as it protects the interior top portion of the bag from being exposed to the product being filled into the bags, and thereby assures a strong and air tight seal each time. As pointed out above, the particular design disclosed herein is relatively simple, easy to manufacture, sturdy, and very simple and easy and convenient to use.

The terms "upper", "lower", "forward", "rearward", etc., have been used herein merely for the convenience of the foregoing specification and in the appended claims to describe the filling device for freezer bags and its parts as oriented in the drawings. It is to be understood, however, that these terms are in no way limiting to the invention since the filling device for freezer bags may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A bag support and filling device for maintaining a freezer bag having an open top in an open position for easy filling such as in the home freezing of fruits, vegetables and the like, comprising: a base support unit including upstanding sides with upper terminal edges that includes support means for being inserted into a cuff area formed by turning back a top portion of said open top bag over the outside of said support means so as to define an interior open top portion of the bag about the inside of said support means; funnel means adapted to be inserted into said support means for facilitating the filling of the bag supported therein and to protect the top inner portions of the bag from exposure to the food product being filled within said bag, said funnel means including an integral lower generally inverted V-shaped base for fitting over the upper terminal edges of said sides and a top filling portion extending upwardly from said lower generally inverted V-shaped base, said lower inverted V-shaped base including an inner insert wall that extends around said funnel means and is designed to be inserted interiorly of said support means and downwardly into the defined interior opening top bag portion for protecting this portion of said bag from exposure to product material being filled into said bag, said lower generally inverted V-shaped lower base portion further including an outer skirt that joins said inner insert wall and projects generally outwardly and downwardly therefrom over the upper terminal edges of said sides and the cuff portion of said bag disposed outwardly of said sides so as to define an open generally inverted V-shaped space around said funnel means between said inner insert wall and said skirt that acts to receive the upper terminal edges of said sides with said sides acting to support said entire funnel means by projecting upwardly into said defined V-shaped space between said inner insert wall and said skirt, whereby said skirt portion of said funnel means shields and protects the exposed cuff area of said bag from spillage of the product material being filled into said bag.

2. The bag support and filling device of claim 1 wherein said sides comprise two face-to-face and laterally spaced sides that extend upwardly so as to define an open area therebetween, and wherein each side includes an upper terminal edge that comprises said support means for being inserted within the formed cuff of the bag when supported, and wherein said sides are flexible such that they will slightly expand and yield for inserting said insert means therebetween, whereupon said sides exert a holding force against said insert means.

3. The bag support and filling device of claim 2 wherein said insert wall comprises a plurality of sides that project downwardly interiorly of said sides of said base support unit and adjacent the interior of said bag, and wherein said insert wall is of a generally rectangular horizontal cross sectional area so as to define a generally rectangular opening about the interior open top bag portion of said bag when supported by said bag support and filling device.

4. The bag support and filling device of claim 3 wherein said base support unit includes a generally horizontal bottom and wherein said sides project generally upwardly and inwardly from opposite ends thereof for a predetermined distance at which point said sides project generally upwardly in parallel relationship such that the lateral space between the sides at the bottom is greater than the lateral space between the sides at the top.

5. The bag support and filling device of claim 4 wherein said skirt projecting generally outwardly downwardly from said insert wall includes four sides.

6. The bag support and filling device of claim 5 wherein said base support unit comprises said bottom and sides is integral constructed in the form of a plastic like material.

7. A bag support and filling device for maintaining a freezer bag having an open top in an open position for filling such as in the home freezing of fruits, vegetables and the like, comprising: a base support unit having a horizontal base and two slightly flexible face-to-face and laterally spaced upstanding sides that project upwardly from said base to define two opposite open side areas and an open area between said face-to-face sides, said sides including upper terminal edges for being inserted into a cuff area formed by turning back a top portion of said open top bag over the upper terminal edges of said sides so as to define an interior open top portion of the bag about the upper inside area of said sides; and funnel means adapted to be inserted into said base support unit to facilitate filling the supported bag and for protecting upper inner areas of said bag from exposure to the product material being filled, said funnel means including an inner insert wall adapted to be inserted interiorly of said sides and downwardly into the defined interior open top bag portion and including means for protecting the interior top bag portion of the supported bag from exposure to product material being filled into the bag, said funnel means including an upper funneling portion that extends upwardly from said inner insert wall in a diverging fashion to form an open top filling area about said funnel means to facilitate filling the bag and skirt means the projects generally outwardly and downwardly from said inner insert wall for generally shielding the outer portion of said open topped bag cuffed over the upper terminal edges of said sides.

8. The bag support and filling device of claim 7 wherein said skirt means joins said inner insert wall and projects generally outwardly and downwardly therefrom forms a generally inverted V-shaped open space around the entire lower portion of said funnel means wherein said generally inverted V-shaped space acts to receive the upper terminal edges of said sides for supporting said funnel means about said base support unit.

* * * * *